US005810674A

United States Patent [19]

Falossi et al.

[11] Patent Number: 5,810,674

[45] Date of Patent: Sep. 22, 1998

[54] LIGHT EMITTING POSITIONING SYSTEM

[76] Inventors: Aldo Falossi, 715 Redwood Pl., Reno, Nev. 89502; Paul Thomas, 1257 W. O'Farrell St., San Pedro, Calif. 90731

[21] Appl. No.: 762,520

[22] Filed: Dec. 9, 1996

Related U.S. Application Data

[62] Division of Ser. No. 602,296, Feb. 16, 1996, Pat. No. 5,593,354.

[51] Int. Cl.[6] ..... A63B 69/36

[52] U.S. Cl. ..... 473/220; 33/700; 33/701; 473/407; 473/251; 359/480

[58] Field of Search ..... 473/220, 407; 33/700, 701; 359/480

[56] References Cited

U.S. PATENT DOCUMENTS 5,354,314 10/1994 Hardy et al. ..... 606/130

5,482,283 1/1996 Wali ..... 423/220

5,593,354 1/1997 Falossi et al. ..... 473/220

*Primary Examiner*—George J. Marlo

*Attorney, Agent, or Firm*—Thomas I. Rozsa; Tony D. Chen

[57] ABSTRACT

A golf club laser positioning system is utilized as a golf training device for assisting a novice or professional golfer to properly direct a golf ball in the desired path. The golf club laser positioning system comprises a golf club which has a pair of light emitters mounted within the head portion of the club and will permit the golfer to adjust the light beams depending on the distance desired and the angulation of the terrain. The light emitters transmit the light beams which intersect each other at a remote common point. The laser positioning system allows the golfer to precisely select the correct angle and position of the head portion in relation to the desired path.

12 Claims, 9 Drawing Sheets

LIGHT EMITTING POSITIONING SYSTEM

This application is a Divisional of patent application Ser. No. 08/602,296 filed on Feb. 16, 1996, now U.S. Pat. No. 5,593,354 issued on Jan. 14, 1997.

BACKGROUND OF THE INVENTION

1. Field of The Invention

The present invention generally relates to the field of golf accessories. More particularly, the present invention relates to the field of golf training devices for assisting a novice or professional golfer to properly direct the travel path of a golf ball.

2. Description of The Prior Art

Generally, there are many golf training devices which have been developed over the years for improving a golfer's game. None of the prior art golf training devices are adequate for training a golfer to properly direct the travel path of a golf ball, in which a device will enable a golfer to visualize or witness the forward direction of the golf club head. In the following text, the "direction of the head" is defined as the forward direction which is normal to the face of the golf club head.

Therefore, it is highly desirable to have a very efficient and also very effective design and construction of a golf training device to fine tune a golfer's game. It is desirable to provide a golf club with the capability to point to a direction where the golfer is aiming at, so that the golfer will have an image of where the golf ball will be travelling to. It is also desirable to incorporate a light emitting aiming positioning system, wherein it can be applied to other devices such as a cue-stick, pair of binoculars, etc.

SUMMARY OF THE INVENTION

The present invention is a light or laser emitting positioning system which is utilized in a golf club for assisting a novice or professional golfer to properly direct a golf ball in the desired path. The laser positioning system is applied on a golf club which utilizes a pair of light or laser emitters mounted within the head of the golf club and will permit the golfer to adjust the light beams from the emitters depending on the distance of the cup hole and the angulation of the terrain. The laser emitters transmit the light beams which converge to intersect each other at a remote point, for example the cup hole or the flag pole. In the application of a golf club, the laser positioning system allows the golfer to precisely select the correct angle and position of the head of the golf club in relation to his or her selected golf ball direction.

It is therefore an object of the present invention to provide a golf club laser positioning system to assist a golfer to properly direct the travel path of the golf ball, in which a mechanism can be installed within a golf club and allow the user to precisely select the correct angle and position of the golf club head in relation to his or her selected golf ball direction. The mechanism comprises a flexible plate which is mounted within the head of the golf club and a pair of laser emitters mounted on the flexible plate. A cable is attached to the flexible plate and to an inner rod on a handle portion of the golf club. A minuscule clockwise rotation on the handle portion allows the cable to wind on the inner rod, which in turn bends the flexible plate backward such that the light beams of the pair of laser emitters will intersect each other at a remote common point. A minuscule counter-clockwise rotation on the handle portion allows the cable to unwind from the inner rod, which in turn unbends the flexible plate forward or to its original position.

It is a further object of the present invention to provide a golf club laser positioning system to assist a golfer to direct the golf ball properly, in which an elevation mechanism is provided within a golf club such that turning a rotatable cuff bends the bottom portion of the flexible plate which in turn causes the laser emitters to move and point downwardly. Turning the rotatable cuff in the opposite direction unbends the flexible plate which causes a spring means to bias the upper portion of the flexible plate backward which in turn causes the laser emitters to move and point upwardly.

Described generally, the present invention is a laser positioning system utilized in a golf club application. The laser positioning system comprises a pair of laser or light emitters. The laser emitters are utilized as a directional finder for properly directing the travel path of a golf ball.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
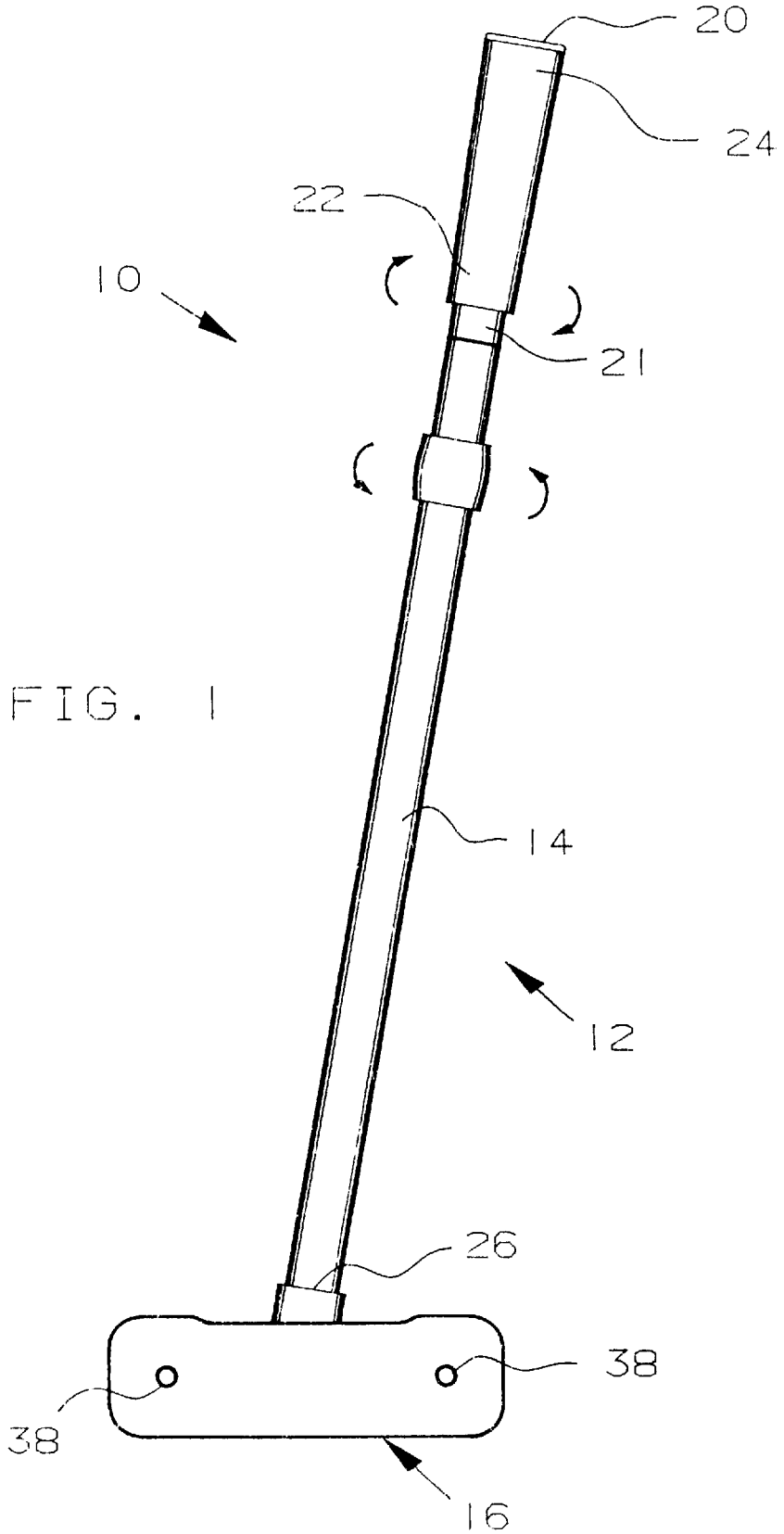
FIG. 1 is a side elevational view of the present invention golf club laser positioning system.

Referring to FIG. 1, there is shown at 10 a golf club which utilizes the present invention light emitting positioning system for assisting a novice or professional golfer to properly direct a golf ball in the desired path. The light emitting positioning system may be LED's, lasers or any other suitable light source means. The golf club laser positioning system 10 includes a golf club 12 which has a bottom head portion 16, an elongated rigid hollow cylindrical shaped shaft 14, and an upper hollow cylindrical handle portion 18 (see FIG. 2). The golf club 12 includes a mechanism which is incorporated therein and is a directional finder to be used as a teaching device which gives an alignment reference point of where the golf ball will be travelling to. It will be appreciated that the golf club 12 illustrated in the drawings can include many other comparable types of golf clubs.

Figure 2:
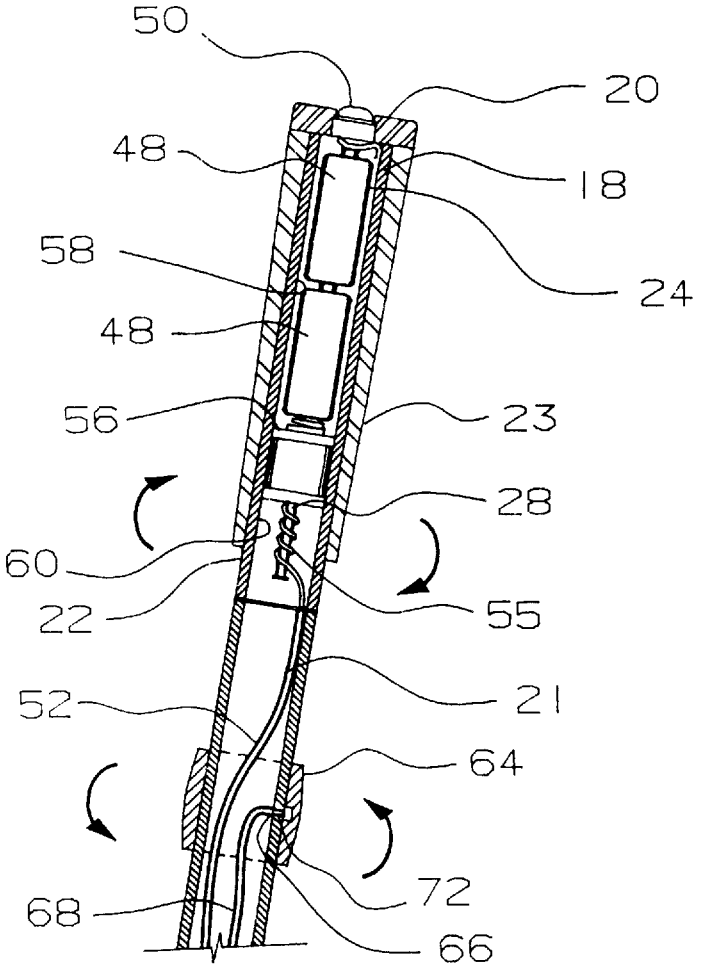
FIG. 2 is a cross-sectional view of the upper portion of an elongated hollow cylindrical shaped shaft of the golf club.

FIG. 2 illustrates a partial cross-sectional view of the upper portion of the elongated rigid hollow cylindrical shaped shaft 14 and the handle portion 18. Referring to FIGS. 1 and 2, the hollow cylindrical shaped shaft 14 comprises a proximal end 26 which is fixed to the head portion 16 and a distal end 21. The upper hollow cylindrical handle portion 18 comprises a proximal end 22, a distal end 24, and a cap 20 removably attached to the distal end 24. The proximal end 22 of the handle portion 18 is rotatably mounted to the distal end 21 of the hollow cylindrical shaped shaft 14, and thereby forms the upper part of the golf club 12. The handle portion 18 can be rotated in the clockwise or counter clockwise direction by turning the handle portion 18.

Referring to FIG. 2, there is shown a partition 56 which is disposed and fixed within the hollow handle portion 18. The partition 56 separates the handle portion 18 into an upper chamber 58 and a lower chamber 60. A narrow inner rod or shaft 28 is located within the lower chamber 60 and fixedly attached to the partition 56 such that the narrow inner rod 28 is parallel to the handle portion 18 and rotatable in relation to the handle portion 18. A hand grip 23 is provided and is inserted over and around the upper handle portion 18 for covering the handle portion 18 so that a user can hold the hand grip 23 for swinging the golf club 12.

Figure 4:
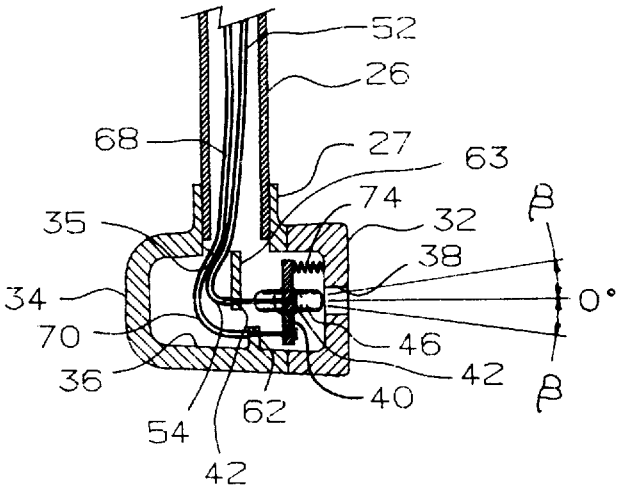
FIG. 4 is a cross-sectional view of the head portion of the golf club.
Figure 3:
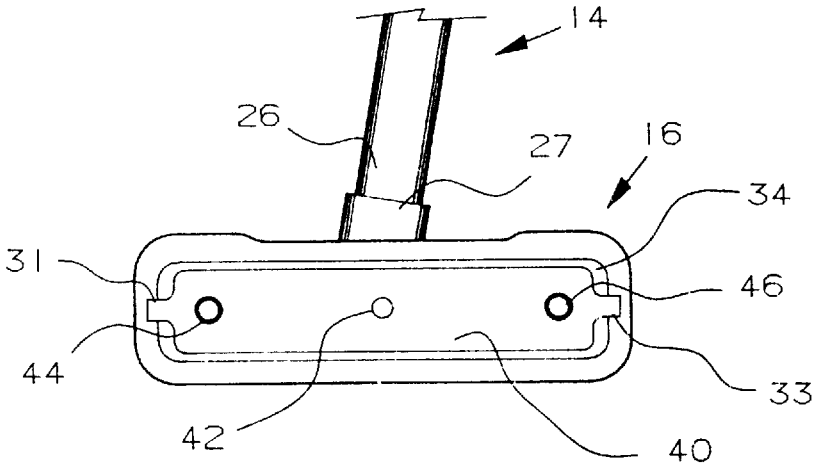
FIG. 3 is a partial side elevational view of the head portion of the golf club, showing the flexible middle plate fixed within the head portion.

Referring to FIGS. 3 and 4, there is shown the bottom head portion 16 of the golf putter 12 which comprises a front housing 32 and a rear housing 34. The front housing 32 is attached to the rear housing 34 by threaded fasteners (not shown) or any other suitable means, thereby forming an interior chamber 36. Holes (not shown) in the rear housing 34 are countersunk so that the threaded fasteners will be flush with the surface of the rear housing 34. The front housing 32 has a pair of opposite openings 38 (see FIG. 1) therethrough. The rear housing 34 has a protruding collar 27 which communicates with a top central opening 35, where the proximal end 26 of the elongated hollow shaft 14 is fixedly attached thereon by gluing or any other suitable means.

A thin flexible middle plate 40 is disposed within the interior chamber 36 of the head portion 16. The flexible middle plate 40 has two opposite wing tips 31 and 33 protruding from the flexible middle plate 40 such that the two wing tips 31 and 33 are loosely secured between the periphery edges of the front and rear housings 32 and 34 of the head portion 16. Where the two wing tips 31 and 33 are attached, there are recesses at these locations so that when the two wing tips are in place and the front and rear housings 32 and 34 are assembled together, there would be no gap between the housings. Once assembled, the flexible middle plate 40 should have sufficient space to bend backward within the interior chamber 36. The flexible middle plate 40 further has a central aperture 42 therethrough.

Figure 5:
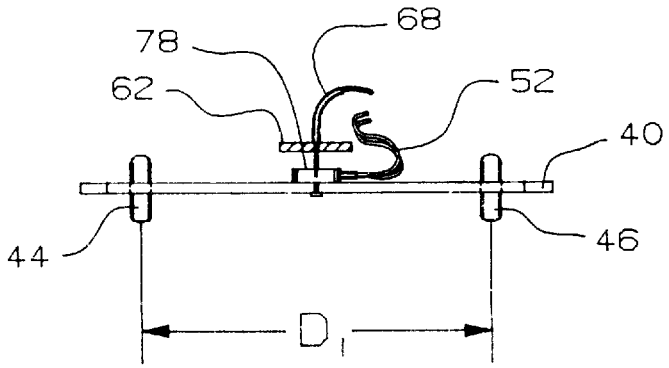
FIG. 5 is a top plan view of the flexible middle plate in its unflexed condition.
Figure 6:
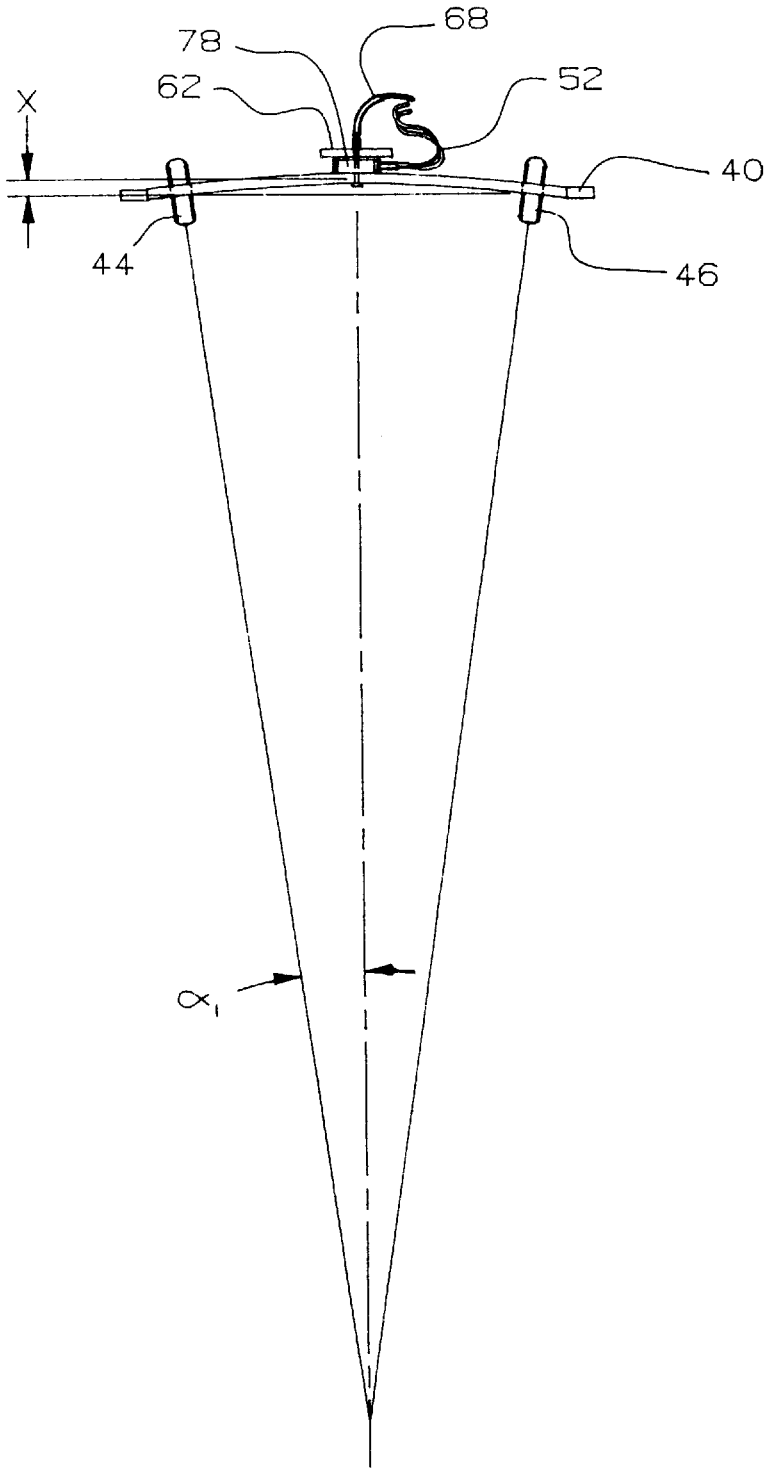
FIG. 6 is a top plan view of the flexible middle plate in its flexed condition.

Referring to FIGS. 4, 5 and 6, there are shown a pair of opposite parallel laser or light emitters 44 and 46 which are mounted on the flexible middle plate 40 at opposite ends, where the central aperture 42 is therebetween. The pair of laser emitters 44 and 46 can emit its light beams through the pair of opposite openings 38 on the front housing 32 respectively (see FIGS. 1 or 4). These openings 38 are precision openings for laser movement. The pair of laser emitters 44 and 46 transmit the light beams substantially in a parallel direction. One of the laser emitters 44 and 46 may either be a red or green beam, but both cannot be the same color. It is preferred that the present invention have at least one red beam and one green beam. The pair of laser emitters 44 and 46 are conventional, and the description thereof will not be described.

Figure 7:
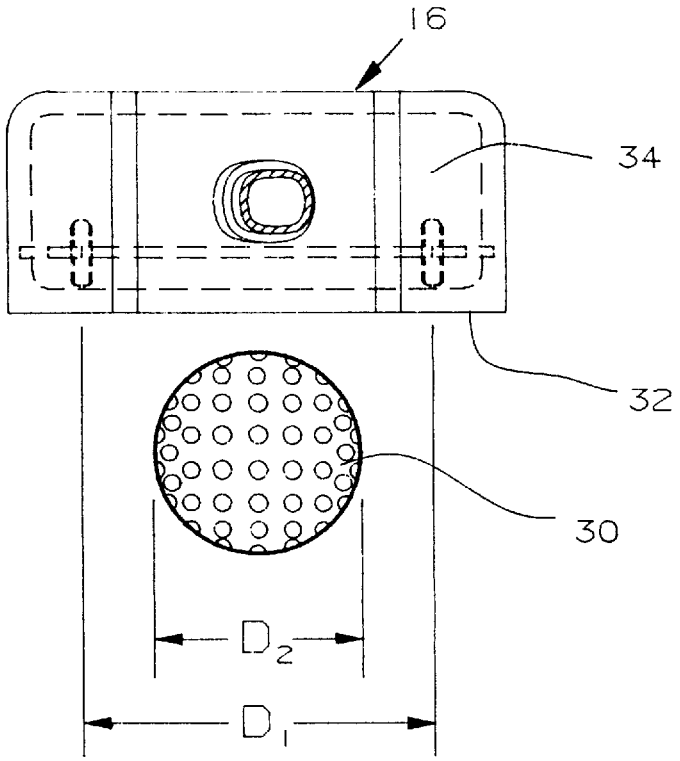
FIG. 7 is a top plan view of the head portion of the golf club.

Referring to FIG. 7, the distance $D_1$, between the light beams is greater than the diameter $D_2$ of the golf ball 30 so that the light beams from the laser emitters will not be blocked by the golf ball 30. By way of example, the distance $D_1$ is approximately ⅓ of a foot. It will be appreciated that the dimensions described above are merely one illustrative embodiment and can include many other comparable sets of dimensions.

Referring again to FIG. 2, the cap 20 of the handle portion 18 is removable such that battery cells 48 can be disposed coaxially inside the upper chamber 58 of the handle portion 18 for providing electrical power to the pair of laser emitters. The pair of laser emitters may be powered by a suitable power source such as two 1.5 volts alkaline 'AA' battery cells 48 which are replaceable by unscrewing the cap 20 from the handle portion 18. It should be understood that the two alkaline 'AA' batteries 48 may be two 'AA' rechargeable batteries or any other suitable power source. Electrical wires (not shown) are conventionally connected from the power source to the pair of laser emitters for powering to the pair of laser emitters.

A micro-switch means 50 is provided with the present invention and is mounted on the cap 20 of the handle portion 18. The user can activate or deactivate the golf club laser positioning system 10 by pushing the switch means 50 to the "ON" or "OFF" position respectively. This will cause the pair of laser emitters to activate or deactivate the light beams respectively.

Referring to FIGS. 2, 3 and 4, there is shown an elongated cable cord 52 which is disposed within the hollow cylindrical shaped shaft 14. The cable cord 52 has an interior core which is sheathed by the cable cord 52. At one end 54 of the cable cord 52, the interior core is inserted through a rigid support 63 and into the central opening 42 of the flexible middle plate 40 (see FIG. 4) and attached thereon by welding or any other conventional means known to one skilled in the art. At the other end 55 of the cable cord 52, the interior cord is wrapped around and attached to the inner rod 28 by welding or any other suitable means, where the cable cord 52 can be wound on the inner rod 28 when the handle portion 18 is rotated.

To bend the flexible middle plate 40, the handle portion 18 is rotated slightly such that the cable cord 52 pulls the flexible middle plate 40 backward towards the rear housing 34, which in turn bends the flexible middle plate 40 (see FIG. 6) and the pair of laser emitters 44 and 46 are moved inwardly toward each other. The wing tips 31 and 33 of the flexible middle plate 40 will maintain the flexible middle plate 40 in position. A minuscule clockwise rotation on the handle portion 18 allows the cable cord 52 to wind on the inner rod 28, which in turn releases the flexible middle plate 40 back to its original position (see FIG. 5) or moves the laser emitters 44 and 46 slightly away from each other such that the light beams will intersect at a remote common point, which is a further location from the previous location. A minuscule counter-clockwise rotation on the handle portion 18 allows the cable cord 52 to unwind from the inner rod 28 which in turn releases the flexible middle plate 40. The handle portion 18 will have a locking means (not shown) which will maintain the rotated position of the handle portion 189. The handle portion 18 may have a scale which can represent the rotational movement of the handle portion 18. The locking means may have a click type locking means wherein each click can represent 1° up to 5°. The maximum distance that the light beams can aim at a point is approximately 40 to 60 feet, and the minimum distance is approximately 4 to 6 feet.

The handle portion 18 further comprises means for tilting the flexible middle plate 40 which in turn adjusts the angle of the laser emitters 44 and 46 with respect to the horizontal plane. A rigid plate 62 is integrally formed within the interior chamber 36 of the rear housing 34 and located just below the rigid support 63. A hollow cylindrical rotatable cuff 64 is mounted on and covers an opening 66 on the elongated hollow cylindrical shaped shaft 14 and is located adjacent to the distal end 21. A second elongated cable cord 68 is disposed within the hollow shaft 14. The second cable cord 68 is similar to the first cable cord 52 such that it has an interior core which is sheathed by the cable cord 68. At one end 70 of the cable cord 68, the interior core is attached to the rigid plate 62 and the flexible middle plate 40 by conventional means. The other end 72 of the cable cord 68 is inserted through the opening 66 and attached to the rotatable cuff 64, where the rotatable cuff 64 can be rotated to tilt the flexible middle plate 40, thereby causing the laser emitters 44 and 46 to be tilted as well. The rotatable cuff 64 can only rotate approximately a90° to 120°. A spring means 74 is provided and located between the interior surface of the front housing 32 and the flexible middle plate 40. This spring means 74 provides the balance force to the flexible middle plate 40. As the rotatable cuff 64 is rotated clockwise, the second cable cord 68 pulls the bottom portion of the flexible middle plate 40 backward towards the rear housing 34 which in turn causes the laser emitters 44 and 46 be to tilted downwardly. The wing tips 31 and 33 of the flexible middle plate 40 will act as the pivot points for the flexible middle plate 40. When the rotatable cuff 64 is rotated in the opposite direction, the flexible middle plate 40 is released such that the spring means biases the upper portion of the flexible middle plate 40 backward towards the rear housing, and thereby causes the laser emitters to tilted upwardly. At the balance position, the laser emitters 44 and 46 are aimed in a horizontal direction.

Electrical wires (not shown) are located inside and concealed within the hollow cylindrical shaped shaft 14 for providing electrical connection between the switch means 50, battery cells 48 and the laser emitters 44 and 46. This not only is aesthetically pleasing but eliminates the risk of the golfer becoming tangled with the electrical wires.

It will be appreciated that the electrical connections of the present invention golf club laser positioning system 10 are conventionally wired, which is well known to one skilled in the art, and the description thereof will not be described.

Referring to FIG. 4, the rotatable cuff 64 has a stiff locking means (not shown) which will maintain the rotated position of the rotatable cuff 64. The rotatable cuff 64 may have a scale (not shown) which can represent the rotational movement of the rotatable cuff 64. The locking means may have a click type locking means wherein each click represents β° angle, where the β° angle is approximately a small portion of the overall angle in either direction, where the 0° is the neutral position.

Figure 8:
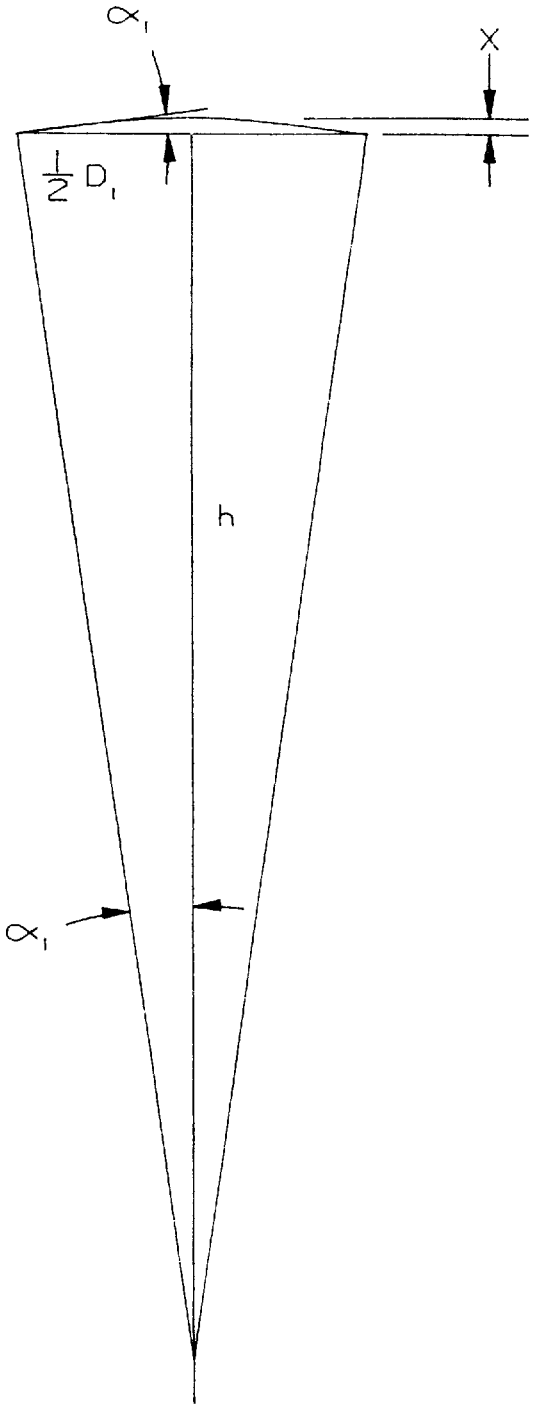
FIG. 8 is a diagram illustrating how the distance and angles can be mathematically calculated utilizing a strain gage.

Referring to FIGS. 5, 6 and 8, the present invention golf club laser positioning system also provides a set of strain gages 78. The bending of the flexible middle plate 40 creates a stress. The strain gages 78 sense the stress such that the amount of stress determines the deflection, where the distance from the head portion to the point where the light beams intersect each other can be calculated mathematically as shown in FIG. 8. The equation can be defined as:

$$\tan \alpha \approx x/\tfrac{1}{2}D_1 \qquad [1]$$

$$\alpha \approx \alpha_1$$

$$h \approx \tfrac{1}{2}D_1/\sin \alpha_1 \qquad [1]$$

where:

- $\alpha$ is the angle of deflection from the flexible middle plate;
- $\alpha_1$ is the angle between one of the light beams and direction center of the head portion;
- $D_1$ is the distance between the two laser emitters;
- x is the amount of deflection of the flexible middle plate; and
- h is the distance from the head portion to the point where the light beams of the laser emitters intersect each other.

From Equation [2] it can be seen that the distance from the head portion to the point where the light beams intersect each other can be calculated.

Figure 9:
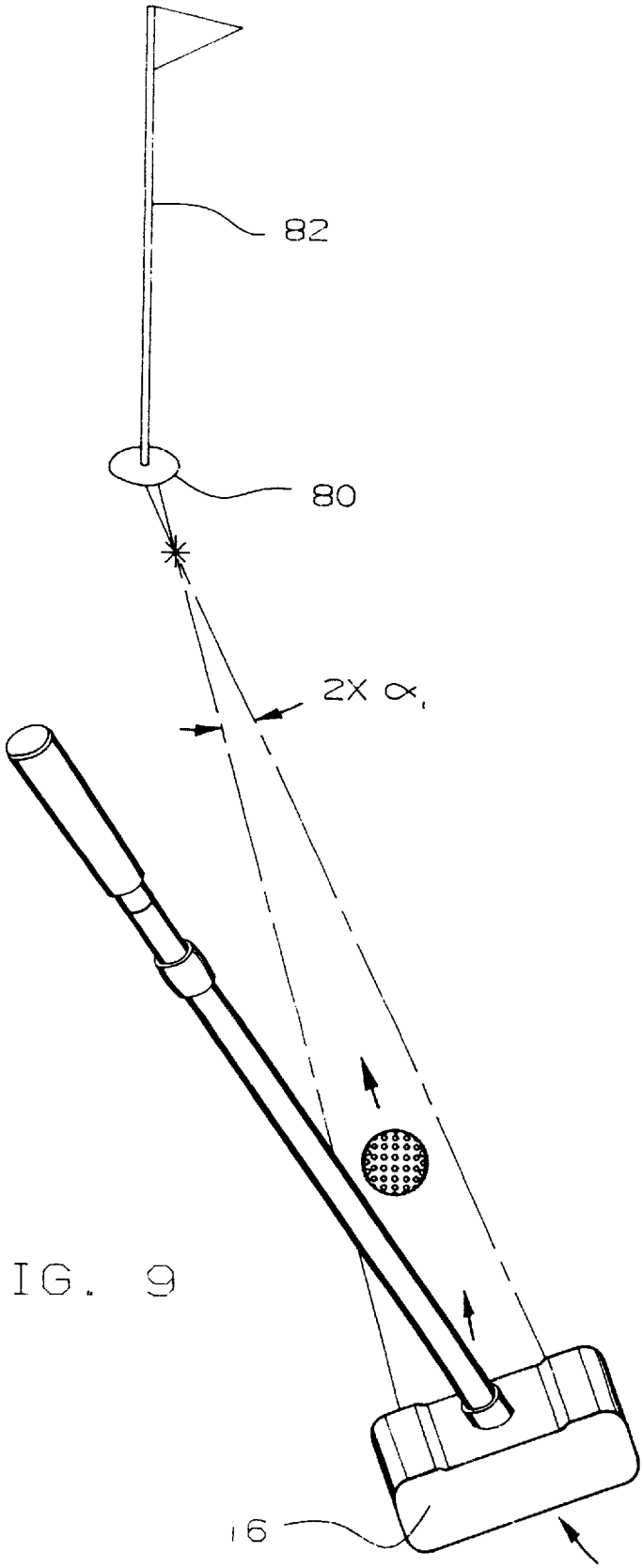
FIG. 9 is an illustration of an application of the present invention laser positioning system utilizing a putter, where the light beams of the laser emitters converge to the cup hole at a remote distance.

Referring to FIG. 9, there is illustrated how the present invention functions with a golf putter. The pair of laser emitters will permit the golfer to adjust the light beams depending on the distance of the cup hole 80 and the angulation of the terrain. It also allows the golfer to precisely select the correct angle and position of the head portion in relation to his or her desired direction. When the pair of laser emitters are activated, the handle portion can be rotated minusculely such that the light beams are intersecting each other at a remote common point away from the golf club, thereby enabling a golfer to direct the travel path of the golf ball. The dotted lines illustrate the light beams from the laser emitters and when they intersect a third color is generated, the distance is measured by converting the force imposed on the strain gauge to position the beam at the selected cross point.

Figure 10:
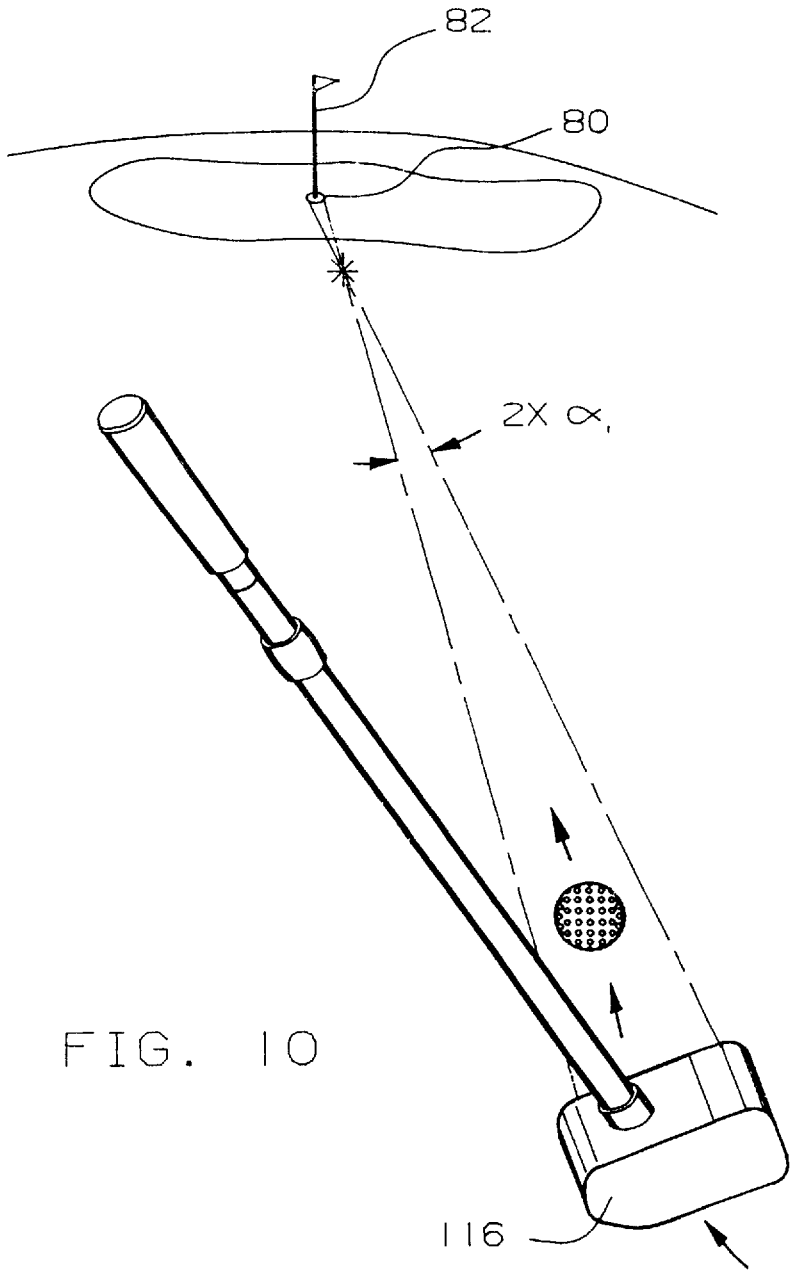
FIG. 10 is an illustration of another application of the present invention laser positioning system utilizing a driving golf club laser positioning system, where the light beams of the laser emitters converge to the cup hole at a remote distance.

Referring to FIG. 10, there is illustrated the present invention laser positioning system in a driving golf club 116. The pair of laser emitters will permit the golfer to adjust the light beams depending on the distance of the cup hole 80 and the angulation of the terrain. It also allows the golfer to precisely select the correct angle and position of the head portion in relation to his or her desired direction. When the pair of laser emitters are activated, the handle portion can be rotated minusculely such that the light beams are intersecting each other at a remote common point away from the golf club, thereby enabling a golfer to direct the travel path of the golf ball. The dotted lines illustrate the light beams from the laser emitters.

Figure 11:
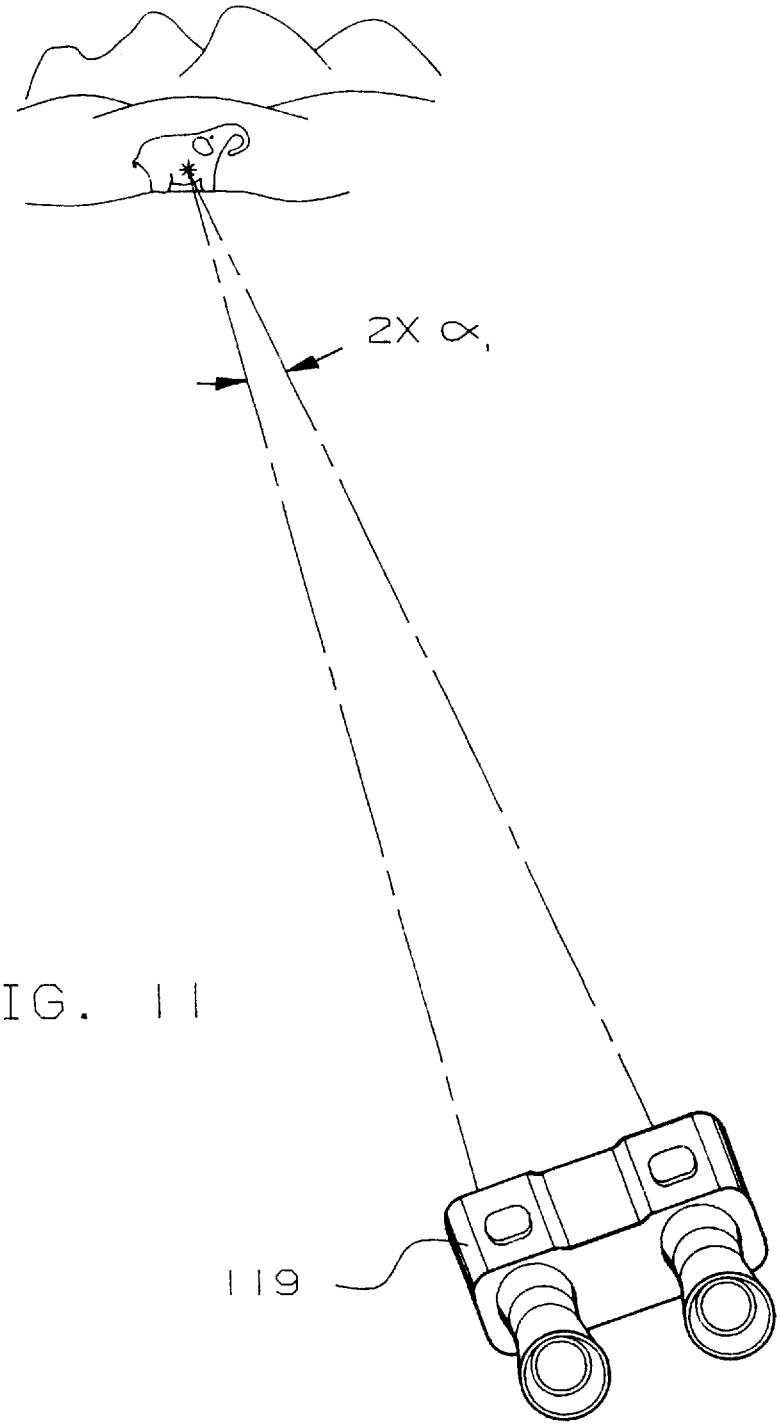
FIG. 11 is an illustration of still another application of the present invention laser positioning system, showing the light beams of the laser emitters converging to an object at a remote distance.

Referring to FIG. 11, there is illustrated the present invention laser positioning system in a binocular application. The pair of laser emitters will permit the user to adjust the light beams depending on the distance of the object which is an elephant. It also allows the user to precisely measure the distance of the object. When the pair of laser emitters are activated, the light beams are intersecting each other at a remote common point away from the binoculars, thereby enabling a user to determine the distance of the object. The dotted lines illustrate the light beams from the laser emitters.

The present invention conforms to conventional forms of manufacture. The manufacturing process which could accommodate the construction of the golf club 12 may be injection, thermoform, etc. or other molding process. By way of example, the flexible middle plate 40 can be made of metal, plastic or any flexible suitable material, which enables the flexible middle plate 40 to bend back and forth.

It will be appreciated that the laser positioning system is not limited to the applications described above. It is also within the spirit and scope of the present invention to have the laser positioning system incorporated in a multiplicity of applications, for example, a cue-stick for playing pool or any other non-golfing applications.

Defined in detail, the present invention is a golf club for assisting a golfer to properly direct the travel path of a golf ball, comprising (a) a bottom head portion having a rear housing and a front housing, where the front housing is attached the rear housing and forms an interior chamber, the rear housing having a hollow protruding collar, the front housing having a pair of opposite openings therethrough; (b) a flexible middle plate disposed within said interior chamber and having opposite end wing tips such that the opposite end wing tips are secured between the periphery edges of said front and rear housings of said head portion; (c) a pair of opposite parallel laser emitters mounted on said flexible plate and located remote from each other, where a respective one of the pair of laser emitters can emit its light beams through a respective one of said pair of opposite openings of said front housing; (d) an elongated hollow cylindrical shaped shaft having a proximal end and a distal end, the proximal end fixedly attached to said hollow protruding collar of said rear housing of said head portion; (e) an upper hollow cylindrical handle portion having a proximal end, a distal end, and a cap removably attached to the distal end, the proximal end mounted to said distal end of said hollow cylindrical shaped shaft such that the handle portion can be rotated in any direction; (f) a partition disposed and fixed within said hollow cylindrical handle portion and separating said hollow cylindrical handle portion into a lower chamber and an upper chamber; (g) a narrow inner rod disposed within said lower chamber of said handle portion and attached to said partition and parallel to said elongated hollow cylindrical shaped shaft so that the inner rod is rotatable in relation with said handle portion; (h) an elongated cable cord disposed within said elongated hollow cylindrical shaped shaft and having one end inserted through said central opening of said flexible middle plate and attached thereto and the other end wrapped around said inner rod, where the cable cord can be wound on said inner rod when said handle portion is rotated to bend said flexible middle plate so that the light beams of said pair of laser emitters are moved toward and intersect each other; (i) battery means disposed coaxially inside said upper chamber of said handle portion for providing electrical power to said pair of laser emitters; and (j) switch means mounted on said cap of said handle portion for activating or deactivating said pair of laser emitters; (k) whereby when said pair of laser emitters are activated and transmit the light beams, said upper handle portion can be rotated minusculely so that the light beams of said pair of laser emitters intersect each other at a remote point, thereby allowing the golfer to precisely select the correct angle and position of said head portion in relation to his or her selected golf ball direction.

Defined broadly, the present invention is a golf club for assisting a golfer to properly direct the travel path of a golf ball, comprising: (a) a head portion having a rear housing and a front housing, where the front housing is attached to the rear housing, the front housing having two opposite openings therethrough; (b) a flexible plate having opposite end wing tips such that the opposite end wing tips are secured between the periphery edges of said front and rear housings of said head portion; (c) at least two laser emitters mounted on said flexible plate and remote from each other, where a respective one of the at least two laser emitters can emit its light beams through a respective one of said two opposite openings of said front housing; (d) a hollow shaft having a proximal end and a distal end, the proximal end fixedly attached on said rear housing of said head portion; (e) a hollow handle portion having a proximal end, a distal end, and a cap removably attached to the distal end, the proximal end mounted to said distal end of said hollow shaft such that the handle portion can be rotated in any direction; (f) an inner rod attached within said handle portion and parallel to said hollow shaft so that the inner rod is rotatable in relation with said handle portion; (g) a cable cord disposed within said hollow shaft and having one end attached to said flexible middle plate and the other end wrapped around said inner rod, where the cable cord can be wound on said inner rod when said handle portion is rotated to bend said flexible plate so that the light beams of said at least two laser emitters move and intersect each other; (h) means for providing electrical power to said at least two laser emitters; and (i) means for activating or deactivating said at least two laser emitters; (j) whereby when said at least two laser emitters are activated and transmit the light beams, said handle portion can be rotated minusculely so that the light beams of said at least two laser emitters intersect each other at a remote point, thereby allowing the golfer to precisely select the correct angle and position of said head portion in relation to his or her selected golf ball direction.

Defined more broadly, the present invention is a club for assisting a user to properly direct the travel path of a golf ball, comprising: (a) a rear housing, a flexible plate disposed within the rear housing, and a front housing attached to the rear housing to enclose the flexible plate, the front housing having a pair of spaced apart openings; (b) at least two light beams supported on said flexible plate emitting its lights through said pair of spaced apart openings to intersect each other at a distance; (c) a shaft fixedly attached to said rear housing of said head portion; and (d) means for bending said flexible plate which in turn moves said at least two light beams inwardly to cause them to intersect each other; (e) whereby when said at least two light beams are transmitting their lights, said means for bending said flexible plate moves said at least two light beams inwardly such that the lights intersect each other at a remote point, thereby allowing the user to precisely select the correct angle and position of said head portion in relation to the user selected golf ball direction.

Defined even more broadly, the present invention is a light emitting positioning system for determining the distance and position of an object, comprising: (a) at least two light beams emitting its lights to intersect each other at said object; and (b) means for moving said at least two light beams to cause them to intersect each other, so that when said at least two light beams are transmitting their lights and intersect each other at said object, the at least two light beams thereby allow the user to precisely determine the distance and position of said object.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A positioning system for determining the distance of an object, the system comprising:

a. a flexible structure;

b. at least two light beams supported on said flexible structure and emitting its lights at said object;

c. means for bending said flexible structure which in turn moves said at least two light beams inwardly to cause their lights to intersect each other at a particular distance from the flexible structure; and d. means for measuring an inner stress of said flexible structure when said flexible structure is bent, where a deflection of said flexible structure is calculated in order to determine the particular distance of said object from said flexible structure.

2. The system in accordance with claim 1 wherein said measuring means includes a set of strain gages attached to said flexible structure.

3. The system in accordance with claim 1 wherein said at least two light beams are a red color and a green color respectively.

4. The system in accordance with claim 1 wherein said at least two light beams are generated by laser emitters.

5. The system in accordance with claim 1 further comprising means for providing electrical power to said at least two light beams.

6. The system in accordance with claim 5 wherein said means for providing electrical power to said at least two light beams includes at least two battery cells.

7. The system in accordance with claim 1 further comprising a switch means for activating or deactivating said at least two light beams.

8. A light emitting positioning system for determining the distance of an object, the system comprising:

a. a flexible plate;

b. two laser emitters supported on said flexible plate at opposite locations and emitting its lights at said object;

c. means for bending said flexible plate which in turn moves said two laser emitters inwardly to cause their lights to intersect each other at a particular distance from the flexible plate; and d. a set of strain gages attached to said flexible plate for measuring an inner stress of said flexible plate when said flexible plate is bent, where a deflection of said flexible plate is calculated in order to determine the particular distance of said object from said flexible plate.

9. The system in accordance with claim 8 wherein said two laser emitters are a red color and a green color respectively.

10. The system in accordance with claim 8 further comprising means for providing electrical power to said two laser emitters.

11. The system in accordance with claim 10 wherein said means for providing electrical power to said two laser emitters includes at least two battery cells.

12. The system in accordance with claim 8 further comprising a switch means for activating or deactivating said two laser emitters.

* * * * *